United States Patent [19]

Munro et al.

[11] Patent Number: 4,830,537

[45] Date of Patent: May 16, 1989

[54] FLEXIBLE PIPE OR CABLE LAYING APPARATUS

[75] Inventors: Roderick L. Munro, Ormstown; R. John Weilgut, Osgoode, both of Canada

[73] Assignees: Scoralin Inc., Osgode; Dillingham Construction, Ltd., N. Vancouver, both of Canada

[21] Appl. No.: 183,638

[22] Filed: Apr. 19, 1988

[51] Int. Cl.[4] ..... E02F 5/10; F16L 1/02

[52] U.S. Cl. ..... 405/179; 405/155

[58] Field of Search ..... 405/154, 155, 156, 174, 405/179

[56] References Cited

U.S. PATENT DOCUMENTS

| | | | |
|---|---|---|---|
| 2,209,726 | 7/1940 | Fleming . | |
| 2,738,745 | 3/1956 | Harpold . | |
| 3,429,134 | 2/1969 | Coffey . | |
| 3,859,809 | 1/1975 | Clayhold et al. | 405/179 |
| 4,028,902 | 6/1977 | Courson et al. | 405/179 X |
| 4,142,817 | 3/1979 | Lazure . | |

FOREIGN PATENT DOCUMENTS

| | | |
|---|---|---|
| 1801608 | 10/1968 | Fed. Rep. of Germany . |
| 2387322 | 11/1978 | France . |
| 703631 | 12/1979 | U.S.S.R. . |
| 1244400 | 9/1971 | United Kingdom . |

*Primary Examiner*—David H. Corbin

*Attorney, Agent, or Firm*—Samuel Meerkreebs

[57] ABSTRACT

A pipe or cable laying apparatus includes a quadrilateral linkage device mounting the narrow ripping plow to a tractor and a chute body hingedly mounted to the trailing edge of the plow. The chute body includes a cable conduit compartment therein, and a separate chute and hopper for passing particulate materials through the body, and an auger device provided at the bottom of the body. The auger device is hollow and communicates with the cable conduit. The other end of the hollow auger device communicates with a discharge opening in the bottom of the body while the chute provides a steady gravity flow of particulate material to the auger.

5 Claims, 4 Drawing Sheets

C
40a 50
28b
28
30
30b
30c
16
44
46
40
48
38
C
34
32
42
36

C
140

128b
128
150
130
130c
144
140
150
116
48
146
132
C
140
142

FLEXIBLE PIPE OR CABLE LAYING APPARATUS

BACKGROUND OF THE INVENTION

1. Field of the Invention

The present invention relates to an apparatus for trenching soil and simultaneously laying flexible drainage pipe or cable, and more specifically to an improved device for forming a uniform layer of gravel or concrete about the pipe or cable being laid.

2. Description of the Prior Art

It is well known to use a ripper type plow in the form of a trencher mounted behind a tractor vehicle for forming a narrow trench in the soil and simultaneously laying drainage pipe in the trench. It is also known to provide a layer of gravel uniformly around such drainage pipe. Examples of such devices are illustrated in U.S. Pat. Nos. 4,142,817, Lazure, Mar. 6, 1979; 3,859,809, Clayhold et al, Jan. 14, 1975; amongst others.

SUMMARY OF THE INVENTION

It is an aim of the present invention to provide an improved trenching and pipe or cable laying apparatus which overcomes problems inherent in the known devices.

More specifically, it is an aim of the present invention to provide an improved chute and pipe or cable combination.

In a construction in accordance with the present invention, there is provided an apparatus for trenching and laying a flexible pipe or cable adapted to be mounted on the rear of a vehicle. The apparatus comprises a narrow ripper plow and means for mounting the plow to the vehicle. A laying device includes an upright body defining a narrow chute compartment flared and open to the top. The lower portion of the body has a pipe or cable discharge opening and a hollow auger means communicating with the discharge opening. The chute compartment communicates with the auger means, and the hollow portion of the auger means communicates with a pipe or cable conduit compartment defined in the body such that the flexible pipe or cable can be fed through the body from an external supply means independently of the chute compartment through the hollow auger and out the discharge opening while ravel or concrete fed through the chute is evenly distributed by the auger around the pipe or cable. The narrow body is hingedly mounted about a substantially vertical axis to the ripper plow at the trailing edge thereof.

In a more specific embodiment of the present invention, there is provided an elongated upright body with a forward, substantially vertical pipe or cable conduit compartment including an inlet at the top of the body separate from the chute.

In a still more specific embodiment of the present invention, the chute compartment has a narrow width portion below the flared portion and the width gradually increases towards the bottom of the chute such as to facilitate the gravity flow of the gravel or we concrete in the chute compartment.

An apparatus in accordance with the above described invention comprises two parts, namely, a forward plow member, and hinged to the trailing edge of the plow member is a chute body incorporating the chute, flexible pipe or cable conduit and auger feed. Thus, in the event that a different size conduit is required for handling different size pipes, for instance, it is merely necessary to change the chute body and not the whole apparatus.

BRIEF DESCRIPTION OF THE DRAWINGS

Having thus generally described the nature of the invention reference will now be made to the accompanying drawings, showing by way of illustration, a preferred embodiment thereof, and in which.

DESCRIPTION OF THE PREFERRED EMBODIMENTS

Figure 1:
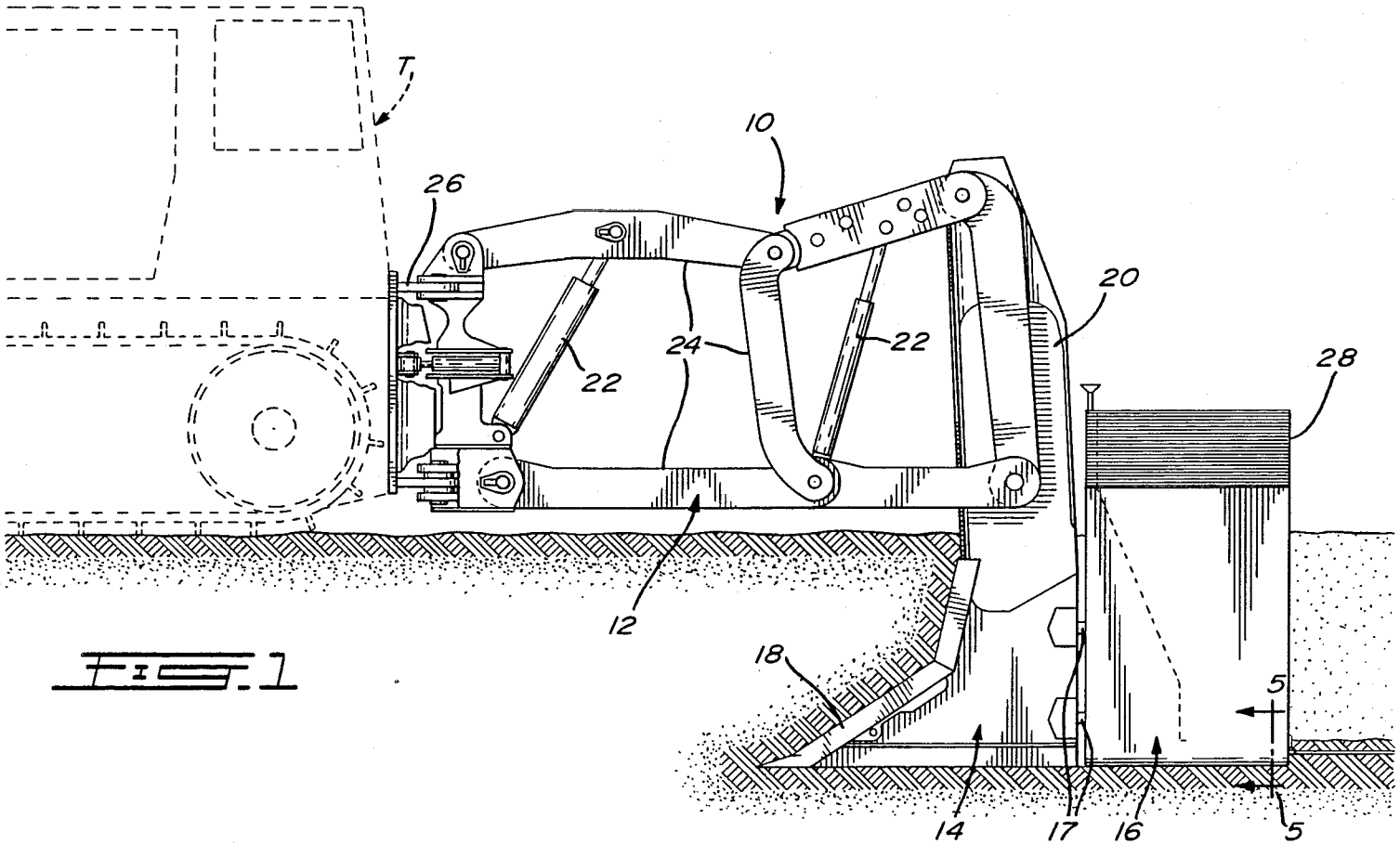
FIG. 1 is a side elevation of an embodiment of the present invention in operation.

Referring to FIG. 1, there is shown an apparatus for trenching and laying pipes or cables simultaneously. In this embodiment, there is a tractor T shown in dotted lines to which is hingedly mounted a linking mechanism 12 mounting a plow element 14 and a chute and cable laying device 16 hingedly mounted to the trailing edge of the plow element 14. The linkage 12 mounting the plow or trench and cable laying apparatus is in the form of a double quadrilateral including link members 24 and hydraulic piston and cylinder devices 22 for actuating the linkage to thereby operate the plow and cable laying apparatus at different attitudes and different levels within a vertical plane behind the tractor T. The plow could also be mounted on a single quadrilateral linkage.

The plow 14 includes a replaceable front ripper plow blade 18 and an upright tower 20 connected to the linkage 12. The plow is narrow as with other trenching plows of this type but includes no other facility for laying the cable or otherwise. Instead, the chute body 16, which is hingedly mounted at 17 to the trailing edge of the plow 14, is provided with the cable laying and gravel distribution facilities.

Figure 2:
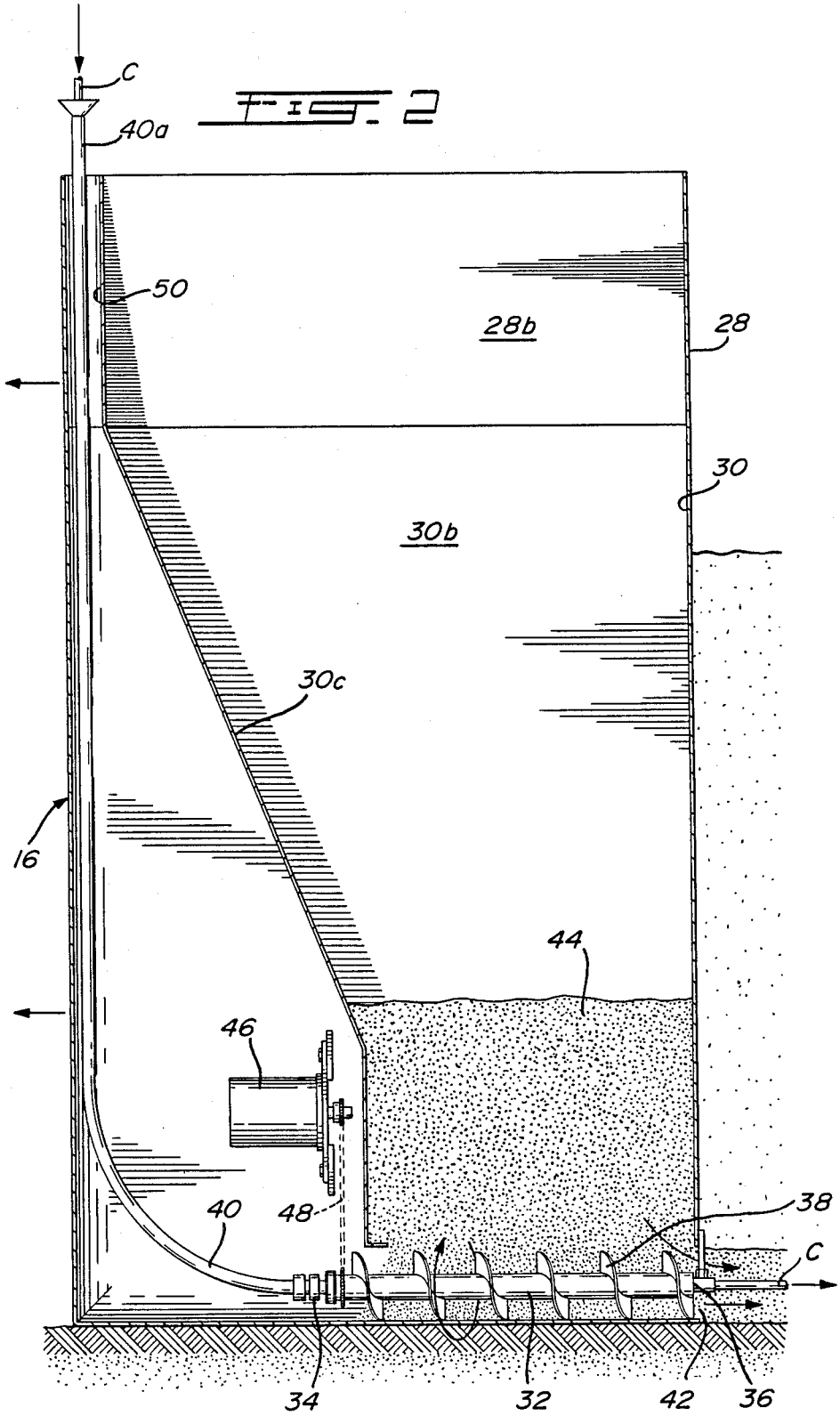
FIG. 2 is an enlarged axial cross-section of a detail of the present invention.
Figure 3:
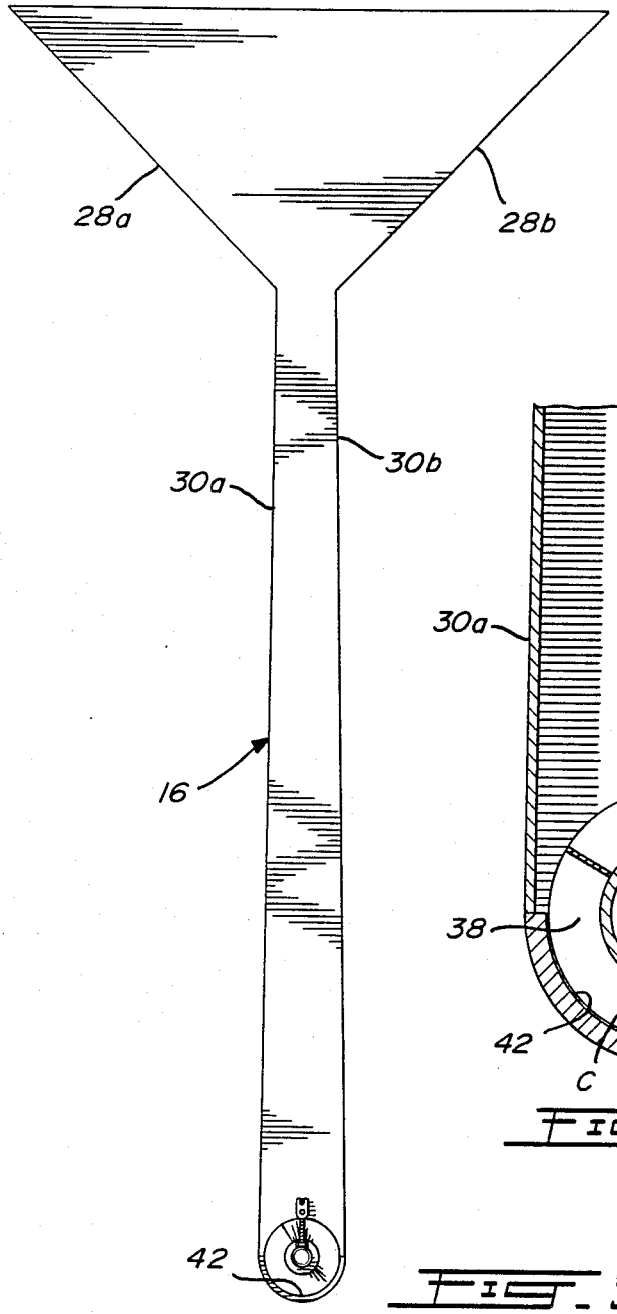
FIG. 3 is an end elevation of a detail of the invention as shown in FIG. 1.
Figure 5:
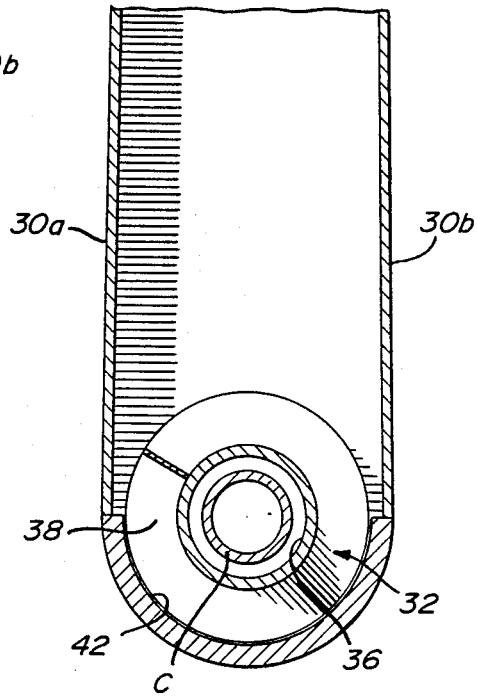
FIG. 5 is an enlarged fragmentary cross-section taken along line 5—5 of FIG. 1.

Referring now to FIG. 2, there is shown within the body 16 a chute 30 with a hopper portion 28 having side walls **28*a* and 28*b*, as shown in FIG. 3. The side walls of the chute 30, namely, walls 30*a* and 30*b*, diverge outwardly from the neck portion with the hopper 28 towards the bottom of the body. At the bottom of the chute is an auger 32** as will be described further.

In the forward portion of the body 16 is the conduit compartment 50 including the cable conduit 40 communicating with the auger 32 at one end and with an inlet **40*a* at the other end. Cable C is fed through the rigid conduit 40 to the auger 32. The radius of the conduit 40 is determined by the flexibility and size of the cable or pipe to be laid. A wall 36 divides the conduit compartment 50 from the chute compartment 30 of the body 16**.

The auger is mounted by suitable bearings within the housing forming the body 16. As previously indicated, the auger is hollow and includes a bore 36 through which the cable C is fed. Spiral blades 38 are provided on the exterior surface of the auger 32. The cable C is discharged through the discharge opening 42 at the bottom of the body 16 as shown. An electric motor 46 drives the auger 32.

Thus, when it is necessary to lay pipe or cable, the plow 14 creates a narrow trench as it is being pulled behind the tractor T. Either gravel or wet or powder concrete or other particulate material can be fed into the hopper 28 continuously. The cable C is fed through the conduit 40, through the center of the auger 32, and out the discharge opening 42. At the same time, the particulate material 44 which is being fed in the chute 30 is distributed about the cable C by means of the auger 32. In certain cable laying applications, it may be necessary to distribute concrete around the cable C. In such a case, the cement powder and sand can be fed through the hopper and chute to be mixed about the cable C and then water is subsequently poured; or wet concrete which is premixed can be supplied through the hopper 28 and chute 30. As indicated, various size cables or flexible drainage pipes can be laid by means of the present invention. If it is necessary to change the size or configuration of the laying device, it is merely necessary to change the body 16, that is, by disconnecting it from the plow 14. This is a simple operation, and several laying bodies 16 can be carried with the apparatus for selective use thereof without major mechanical replacement of the plow and cable laying device as in conventional apparatuses.

The chute 30 is tapered such that the width thereof gradually increases towards the bottom. This is particularly useful when particulate materials are fed in the chute 30 in order to avoid blockages within the chute.

Figure 4:
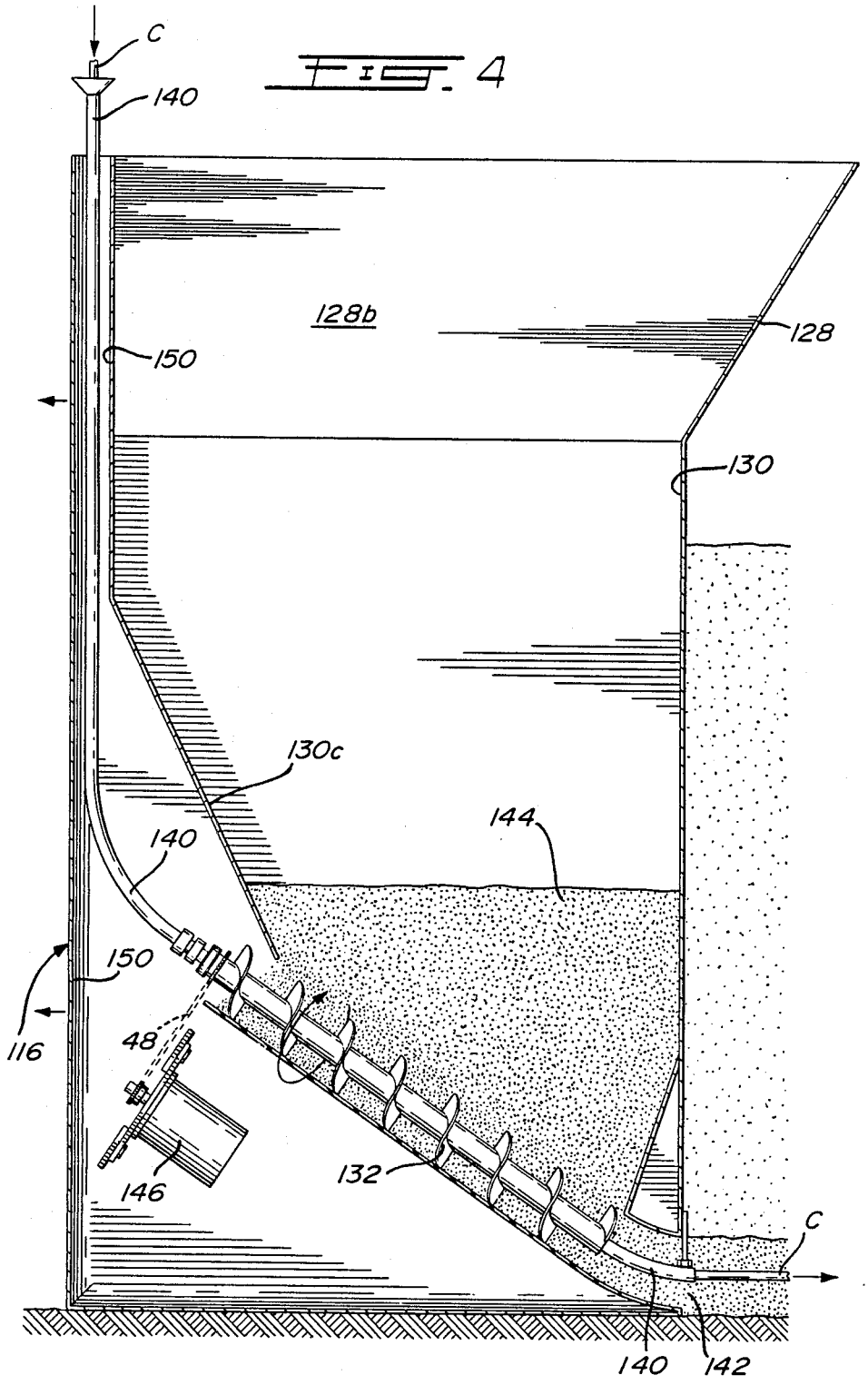
FIG. 4 is an enlarged axial cross-sectional view of another embodiment of the element shown in FIG. 2.

Another embodiment is shown in FIG. 4 wherein the numerals have been increased by 100. In this embodiment, the auger 132 is placed at an angle within tee cable conduit compartment 150. Accordingly, the motor 166, auger 132, and the chute configuration are adapted as shown in FIG. 4. This configuration enables the use of larger diameter, slightly less flexible pipes or cables since the radius of bend within the body is substantially reduced, as can be seen. The inclined auger also allows improved particulate material flow. This configuration furthermore allows a smaller size particulate material envelope to be formed about the pipe or cable, given the narrower taper at the level at which the material is intercepted by the auger in FIG. 4.

We claim:

1. An apparatus for laying pipe or cable which includes a plow member adapted to be articulately mounted rearwardly of a tractor, and a chute body detachably hingedly mounted to the plow member about a substantially vertical axis, the chute body including a chute compartment extending vertically within the body and open to the top in the form of a hopper, a hollow auger means provided in the bottom portion of the body in communication with the chute, and a cable conduit compartment within the chute body separate from the chute compartment and forward thereof, the cable conduit compartment communicating with the hollow portion of the auger for feeding pipe or cable through the conduit and axially through the center of the auger to be fed through to a discharge opening at the bottom of the body.

2. An apparatus as defined in claim 1, wherein the chute compartment is in the form of an upright narrow compartment with downwardly diverging side walls forming an inverted-taper compartment extending from the hopper and ending at the discharge opening whereby the particulate material will fall more freely within the compartment.

3. An apparatus as defined in claim 1, wherein the cable conduit compartment is forward of the body and extends upright to an inlet at the top portion of the body and communicates with the auger means at the bottom of the body.

4. An apparatus defined in claim 1 wherein the auger extends in a horizontal axis at the bottom of the body communicating with the discharge opening.

5. An apparatus as defined in claim 1, wherein the auger is at an angle to the horizontal with one end communicating with the discharge opening of the body and the other end communicating with the cable conduit.

* * * * *